US007182659B2

(12) United States Patent
Noda et al.

(10) Patent No.: US 7,182,659 B2
(45) Date of Patent: Feb. 27, 2007

(54) EXHAUST DEVICE OF BOAT

(75) Inventors: Yoshiaki Noda, Saitama (JP); Masatsugu Matsumoto, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/392,705

(22) Filed: Mar. 30, 2006

(65) Prior Publication Data

US 2006/0223393 A1 Oct. 5, 2006

(30) Foreign Application Priority Data

Mar. 30, 2005 (JP) ..... 2005-097906

(51) Int. Cl.
*B63B 35/73* (2006.01)

(52) U.S. Cl. ..... 440/89 E; 440/89 F

(58) Field of Classification Search ..... 440/89 R, 440/89 E, 89 F
See application file for complete search history.

(56) References Cited

U.S. PATENT DOCUMENTS 4,498,876 A * 2/1985 Zemlicka ..... 440/89 R
6,220,907 B1 * 4/2001 Shimizu ..... 440/89 R
6,773,317 B2 * 8/2004 Dagenais et al. ..... 440/89 E

FOREIGN PATENT DOCUMENTS

JP 2004-98966 A 4/2004

* cited by examiner

*Primary Examiner*—Stephen Avila
(74) *Attorney, Agent, or Firm*—Birch, Stewart, Kolasch & Birch, LLP

(57) ABSTRACT

An open/close valve can decrease the exhaust resistance as much as possible in a usual operation. An open/close valve includes a valve casing and a valve element that is housed in the valve casing in a vertically movable manner. The valve casing includes a cylindrical portion that extends vertically. A through hole is formed in the cylindrical portion. A bottom portion is formed on a bottom of the cylindrical portion. A discharge inlet is formed in an upper portion of the cylindrical portion. The valve element includes a cylindrical body that is arranged along an inner surface of the cylindrical portion and has a height that maintains an opening of the through hole and a seal plate that covers an upper portion of the cylindrical body and has a size capable of closing the exhaust inlet.

19 Claims, 8 Drawing Sheets

EXHAUST DEVICE OF BOAT

CROSS-REFERENCE TO RELATED APPLICATIONS

The present application claims priority under 35 USC 119 to Japanese Patent Application No. 2005-097906 filed on Mar. 30, 2005, the entire contents of which are hereby incorporated by reference.

BACKGROUND OF THE INVENTION

1. Field of the Invention

The present invention relates to an improvement technique of an open/close valve, which is provided on an engine exhaust pipe outlet.

2. Description of Related Art

A boat that has an outlet of an exhaust pipe under water and allows the exhaust pipe to discharge exhaust gas into the water has been popularly used. To prevent water from entering an engine through the exhaust pipe when the boat is turned over, countermeasures have been proposed in, for example, Japanese Patent Application Laid-open No. 2004-98966 (see FIG. 8).

FIG. 8 in the JP 2004-98966 document is a perspective view showing one example of a valve, which is provided on the exhaust structure. The valve 60 (hereinafter referred to as an open/close valve 60) is provided in the vicinity of an exhaust outlet and is formed of a synthetic resin material. The valve 60 has a circular disc shape, wherein segment-like cuts are formed in the open/close valve such that the cut passes the center of the circular disc thus forming a plurality of triangular members 61. When the pressure in the inside of the exhaust pipe 38 is increased, a plurality of triangular members 61 is curved toward the exhaust downstream side. Therefore, the open/close valve 60 is opened in an approximately star shape thus allowing exhaust to be discharged to the outside of the boat to pass therethrough and preventing the intrusion of water from the outside of the boat. The open/close valve 60 performs the valve opening/closing operation by making use of the nature of the open/close valve 60. Specifically, the open/close valve 60 is deflected corresponding to the strength of an applied external force and restores an original state when the external force is removed.

The open/close valve 60 adopts the opening of the valve using the pressure of the exhaust gas as an operational principle thereof. Therefore, exhaust resistance is inevitably generated. When the exhaust resistance is large, the back pressure of the engine is increased thus adversely influencing the engine. When the open/close valve 60 is made easily deflectable to eliminate such an adverse influence, water is liable to easily enter the inside of the exhaust pipe.

Accordingly, there has been a demand for an open/close valve, which does not generate exhaust resistance in a usual state and makes the intrusion of water into the inside of the exhaust pipe difficult.

SUMMARY AND OBJECTS OF THE INVENTION

It is an object of the invention to provide an open/close valve, which can minimize the exhaust resistance in a usual state.

According to a first aspect of the present invention, in an exhaust device of a boat comprising a boat body that includes a hull which forms a boat bottom and a deck which covers the hull, an engine which is arranged in the inside of the boat body, an exhaust pipe which leads an exhaust gas generated by an engine to the outside of the boat body, and an open/close valve which is mounted on an outlet of the exhaust pipe, wherein the open/close valve includes a valve casing and a valve element which is housed in the valve casing in a vertically movable manner, the valve casing includes a cylindrical portion which extends vertically, a through hole which is formed in the cylindrical portion, a bottom portion which is mounted on a bottom of the cylindrical portion, and an exhaust inlet which is formed in an upper portion of the cylindrical portion, and the valve element includes a cylindrical body which is arranged along an inner surface of the cylindrical portion and has a height which allows the maintenance of the opening of the through hole, and a sealing plate which covers an upper portion of the cylindrical body and also has a size which allows the sealing plate to close the exhaust inlet, whereby when the hull is arranged below and the deck is arranged above, the exhaust gas which enters the valve casing through the exhaust inlet is discharged to the outside of the valve casing through the through hole, and when the hull is arranged above and the deck is arranged below, the sealing plate of the valve element which is moved due to an action of gravity closes the exhaust inlet.

When the hull is arranged below and the deck is arranged above, the valve element is moved to the bottom portion side of the cylindrical portion due to a deadweight of the valve element and hence, the exhaust inlet formed in the valve casing and the opening of the through hole are in communication with each other. Therefore, the exhaust gas that enters the valve casing through the exhaust inlet is smoothly discharged to the outside of the valve casing through the through hole.

When the hull is arranged above and the deck is arranged below, the valve element is moved to the exhaust inlet side which is formed on the upper portion of the cylindrical portion due to a deadweight of the valve element. Therefore, the sealing plate of the valve element closes the exhaust inlet whereby it is possible to prevent the intrusion of water from the exhaust inlet as much as possible.

According to a second aspect of the present invention, in an exhaust device of a boat comprising a boat body which includes a hull which forms a boat bottom and a deck which covers the hull, an engine which is arranged in the inside of the boat body, an exhaust pipe which leads an exhaust gas generated by an engine to the outside of the boat body, and an open/close valve which is mounted on an outlet of the exhaust pipe, wherein the open/close valve includes a valve casing and a valve element which is tiltably mounted on the valve casing, the valve casing includes a cylindrical portion which extends vertically, a through hole which is formed in a bottom of the cylindrical portion, and an exhaust inlet which is formed in an upper portion of the cylindrical portion, the valve element includes a sealing plate having a size which allows the sealing plate to close the through hole, an arm portion which extends from the sealing plate to allow the sealing plate to tilt, and a tilting support shaft which is provided on the arm portion at a position where the center of gravity of the valve element at a valve opened position and a valve closed position is offset from a horizontal line which passes a support shaft which tiltably supports the valve element, whereby when the hull is arranged below and the deck is arranged above, the exhaust gas which enters the valve casing through the exhaust inlet is discharged to the outside of the valve casing through the through hole, and when the hull is arranged above and the deck is arranged below, the sealing plate of the valve element which is tilted due to an action of gravity closes the through hole.

When the hull is arranged below and the deck is arranged above, there is no possibility that the sealing plate of the valve element closes the through hole of the valve casing. Therefore, the exhaust gas that enters the valve casing from the exhaust inlet can be discharged to the outside of the valve casing through the through hole.

When the hull is arranged above and the deck is arranged below, the sealing plate of the valve element is tilted about the tilting support shaft and closes the through hole of the valve casing. Therefore, it is possible to prevent the intrusion of water from the exhaust inlet as much as possible.

According to a third aspect of the present invention, the exhaust pipe includes a water muffler in a middle portion thereof, and discharges cooling water together with the exhaust gas from the outlet of the exhaust pipe.

According to the first aspect of the present invention, the open/close valve includes the valve casing and the valve element. Therefore, the open/close valve can be formed in a compact manner. Furthermore, the open/close valve is configured such that the valve element is moved vertically along with the inner surface of the valve casing due to an action of gravity. Therefore, when the hull is arranged below and the deck is arranged above, the exhaust inlet of the valve casing and the opening of the through hole are in communication with each other thus giving rise to an advantage that the exhaust resistance can be decreased.

According to the second aspect of the present invention, the open/close valve includes the valve casing and the valve element. Therefore, the open/close valve can be formed in a compact manner. Furthermore, the open/close valve is configured such that the valve element mounts the tiltable shaft on the arm portion of the valve element at the position where the center of gravity of the valve element is offset at the valve opening position and the valve closing position and the valve element is tiltable due to an action of the center of gravity. Therefore, when the hull is arranged below and the deck is arranged above, the exhaust inlet of the valve casing and the opening of the through hole are in communication with each other thus giving rise to an advantage that the exhaust resistance can be decreased.

According to the third aspect of the present invention, the outlet of the exhaust pipe is opened or closed due to the deadweight of the valve element. Therefore, when the hull is arranged above and the deck is arranged below, it is possible to avoid the intrusion of water from the outlet of the exhaust pipe as much as possible.

When the hull is arranged below and the deck is arranged above, the outlet of the exhaust pipe is largely opened. Therefore, even when the cooling water is discharged together with the exhaust gas, the exhaust resistance is not increased.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
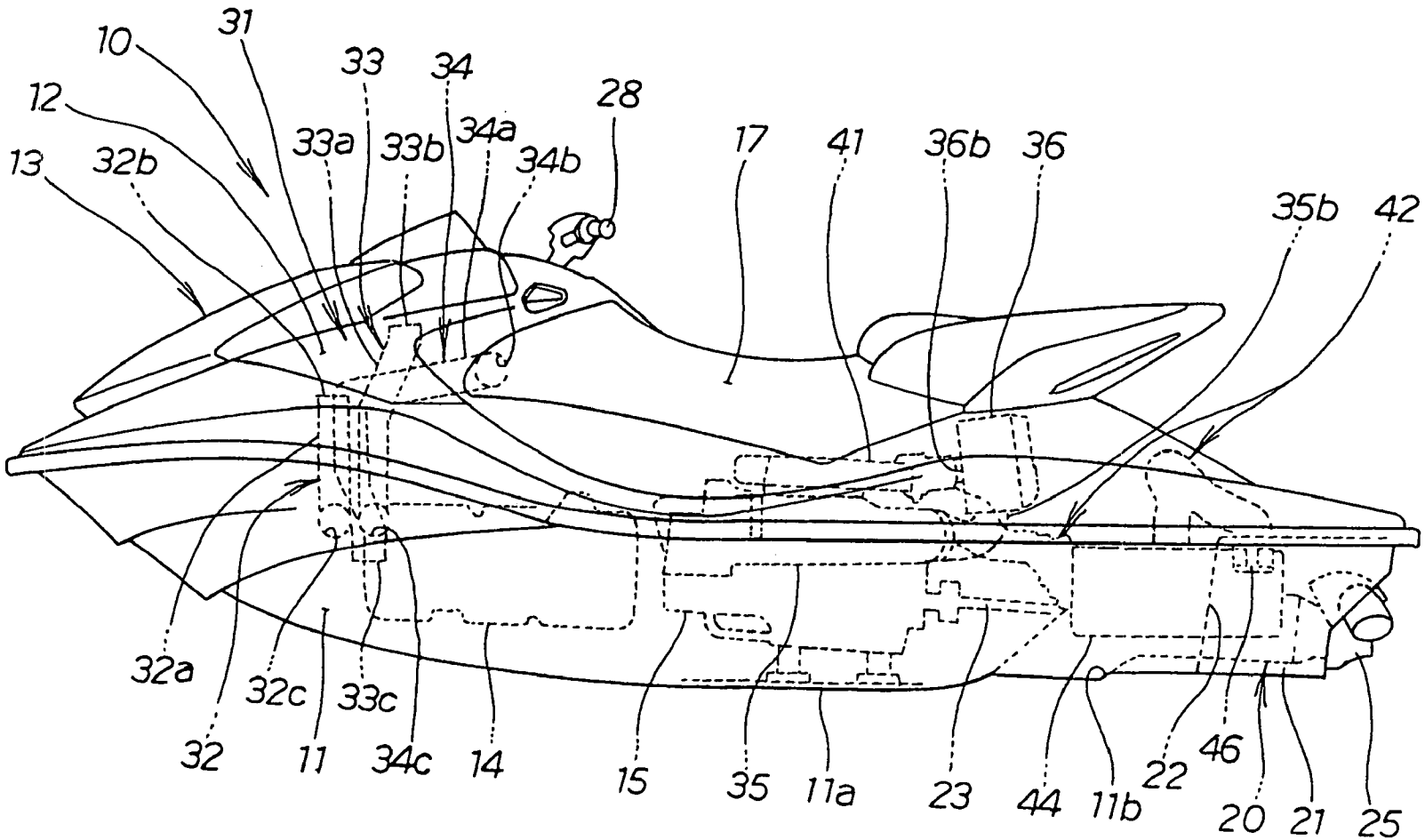
FIG. 1 is a side view of a boat according to the invention.

The present invention will now be described with reference to the accompanying drawings, wherein the same or similar elements are identified by the same reference numeral. It should be noted that the drawings should be viewed in the direction of orientation of the reference numerals.

FIG. 1 is a side view of a boat according to the invention, wherein a boat 10 (also referred to as a jet propelling boat 10) includes a boat body 13 which is constituted of a hull 11 which forms a boat bottom 11*a* (also referred to as a boat bottom 11*a*) and a deck 12 which covers the hull 11 from above. A fuel tank 14 is mounted in the inside of the boat body 13. An engine 15 is arranged behind the fuel tank 14. A saddle-type seat 17 is arranged above the engine 15. A jet pump 20 is arranged behind the engine 15. A steering handle 28 is provided above the fuel tank 14.

The jet pump 20 is a device that includes a pump housing 21, which extends rearwardly from an opening 11*b* formed in the boat bottom 11*a*, which constitutes the hull 11. An impeller (not shown in the drawing) is rotatably mounted in the inside of the pump housing 21. The impeller is connected to a drive shaft 23 of the engine 15.

The engine 15 drives the impeller that the jet pump 20 includes. Therefore, water sucked from the opening 11*b* formed in the boat bottom 11*a* is injected from steering nozzles 25 by way of a pump housing 21. Reference numeral 22 identifies a jet pump chamber that includes the jet pump 20.

The steering nozzles 25 are nozzles that are mounted on a rear end of the pump housing 21 in a state that the steering nozzles 25 are swingable in the lateral direction. The steering nozzles 25 are members for steering that control the steering direction of the boat 13 by swinging in the lateral direction with the manipulation of the steering handle 28.

The jet propelling boat 10 is a boat that travels on water. Supplying the fuel into the engine 15 from the fuel tank 14 drives the engine 15. A driving force of the engine 15 is transmitted to the jet pump 20 by way of the drive shaft 23. Water is sucked from the opening 11*b* formed in the boat bottom 11*a* by driving the jet pump 20. The sucked water is injected as injecting water from the steering nozzles 25 through the rear end of the pump housing 21.

The construction of an intake system provided on the engine 15 will now be described.

An outside air introducing port 31 for introducing outside air into the inside of the boat body 13 is formed in a front portion of the boat body 13. In this embodiment, the outside air introducing port 31 includes three outside air introducing ducts 32, 33 and 34.

The outside air introducing duct 32 is a member which includes a cylindrical body 32*a*, a boat body outside opening 32*b* and a boat body inside opening 32*c*, which are formed on both ends of the cylindrical body 32*a*. The boat body inside opening 32*c* is arranged below the boat body 13 and the boat body outside opening 32*b* is arranged above the boat body 13.

The outside air introducing ducts 33 and 34 are also constructed in the same manner as the outside air introducing duct 32. Specifically, the outside introducing ducts 33, 34 include cylindrical bodies 33*a*, 34*a*, the boat body outside openings 33*b*, 34*b* and the boat body inside openings 33*c*, 34*c*.

To supply air taken in through the outside air introducing ducts 32, 33, 34 into the engine 15, an air duct 35 extends to a rear side from a front side of the engine 15. An air cleaner 36 that purifies air is arranged on a rear end 35*b* of the air duct 35. An intake passage 41 for introducing air from which dust and dirt are removed into the engine 15 extends toward the engine 15 from an outlet 36*b* of the air cleaner.

In this embodiment, the boat body 13 includes the outside air introducing ducts 32, 33, 34. Therefore, it is possible to supply a sufficient amount of outside air into the inside of the boat body 13.

To explain the construction of an exhaust system provided on the engine 15, an exhaust pipe 42 which introduces exhaust gas generated by the engine 15 to the outside of the boat body 13 extends toward a rear side of the engine 15. An open/close valve 46 is mounted on an outlet of the exhaust pipe 42. A water muffler 44 is interposed in a middle portion of the exhaust pipe 42.

Figure 2:
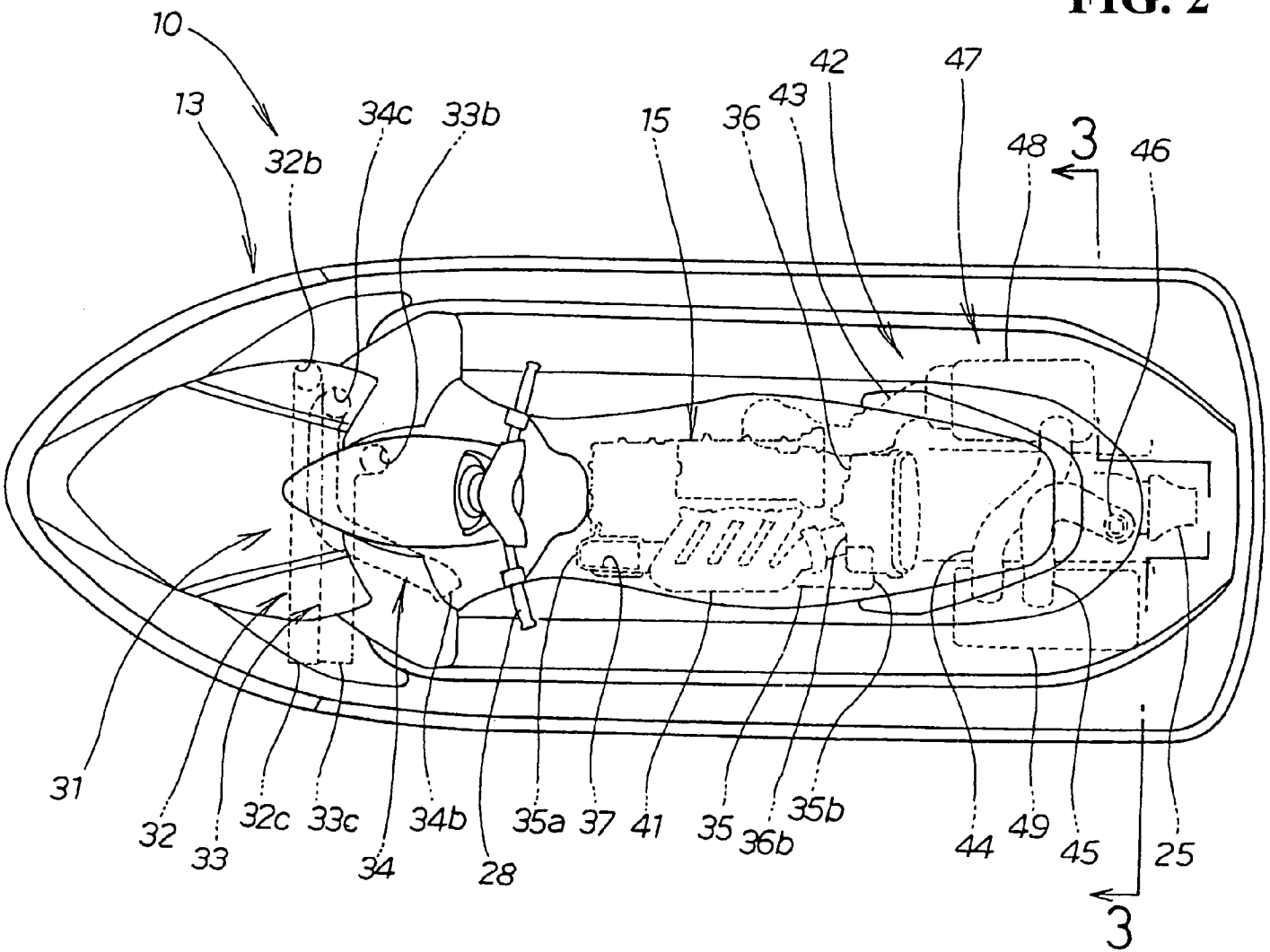
FIG. 2 is a plan view of the boat according to the invention.

FIG. 2 is a plan view of the boat according to an embodiment of the present invention. First of all, the construction of an intake system of the engine will be explained.

The engine 15 is arranged at the approximate center of the boat body 13. The outside air introducing ducts 32, 33, 34 which constitute the outside air introducing port 31 for taking the outside air from the outside of the boat body 13 is arranged front of the engine 15. With respect to the outside air introducing ducts 32, 33, 34, reference numerals 32*b*, 33*b*, 34*b* identify the boat outside openings, and reference numerals 32*c*, 33*c*, 34*c* identify the boat body inside openings. Furthermore, an air duct 35 is arranged behind the boat body inside openings 32*c*, 33*c*, 34*c* of the outer introducing ducts.

The air duct 35 is a member that is longitudinally arranged at a left side of the engine 15. A front opening 37 is provided on a front end 35*a* of the air duct 35. An air cleaner 36 is mounted on a rear end 35*b* of the air duct 35. An intake passage 41 is connected between an outlet 36*b* of the air cleaner and the engine 15.

The intake system of the engine is configured such that the outside air introducing port 31 is formed in the boat body 13 at a position in front of the engine 15 for supplying air to the front opening 37 of the air duct 35. Outside air that is introduced into the inside of the boat body 13 from the outside air introducing port 31 is supplied to the air cleaner 36 through the air duct 35. Subsequently, outside air is supplied to the engine 15 through the intake passage 41 connected to the outlet 36*b* of the air cleaner.

The construction of the exhaust system of the engine will now be explained.

An exhaust pipe 42 that introduces discharge gas generated by the engine 15 to the outside of the boat body 13 is provided. The exhaust pipe 42 is a member that includes a first exhaust pipe 43, a second exhaust pipe 44 and a third exhaust pipe 45. The first exhaust pipe 43, the second exhaust pipe 44 and the third exhaust pipe 45 are connected in this order in the direction that the exhaust gas flows. An open/close valve 46 is mounted on an outlet of the third exhaust pipe 45. At the same time, a first water muffler 48 is interposed between the first exhaust pipe 43 and the second exhaust pipe 44. A second water muffler 49 is interposed between the second exhaust pipe 44 and the third exhaust pipe 45.

In the exhaust device that constitutes the exhaust system, the exhaust pipe 42 that introduces the exhaust gas generated by the engine 15 to the outside of the boat body 13 is provided. The open/close valve 46 is mounted on the outlet of the exhaust pipe 42. At the same time, the water muffler 47 that includes the first water muffler 48 and the second water muffler 49 is interposed in the middle portion of the exhaust pipe 42 thus decreasing an exhaust noise of the engine 15 and leading the exhaust gas of the engine 15 to the outside of the boat body 13.

Figure 3:
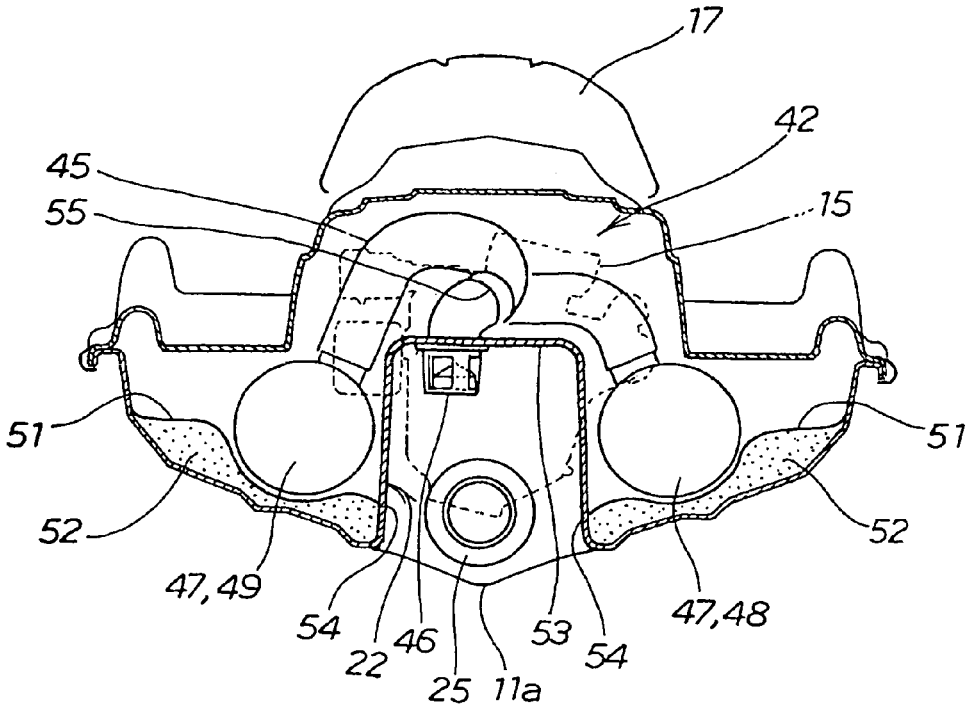
FIG. 3 is a cross-sectional view taken along the line 3—3 in FIG. 2.

FIG. 3 is a cross-sectional view taken along a line 3—3 in FIG. 2. The first water muffler 48 is arranged on a right side of the boat. The second water muffler 49 is arranged on a left side of the boat. The open/close valve 46 is mounted on a top plate 53 that forms a ceiling of the jet pump chamber 22. The second water muffler 49 and the open/close valve 46 are connected by the third exhaust pipe 45 that is arranged therebetween.

The first water muffler 48 and the second water muffler 49 are mounted on outer sides of side plates 54, 54 that form the jet pump chamber 22 using band-like mounting members (not shown in the drawing). To alleviate the vibrations of the boat body 13, a middle bottom 51 is formed on an inner side of the boat bottom 11*a*, and a foamed body 52 is sealed between the boat bottom 11*a* and the middle bottom 51.

The exhaust pipe 42 includes the water muffler 47 that includes the first water muffler 48 and the second water muffler 49 as elements thereof in a middle portion thereof. The exhaust pipe 42 discharges exhaust gas from the open/close valve 46 through an outlet 55 of the third exhaust pipe that includes an outlet of an exhaust pipe.

Figure 4:
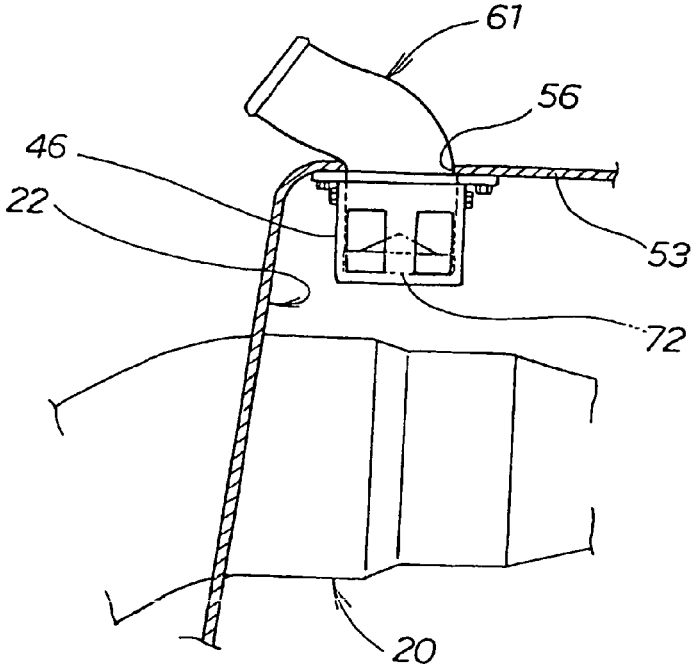
FIG. 4 is a side view of an open/close valve according to the invention.

FIG. 4 is a side view of the open/close valve according to an embodiment of the present invention showing the structure in which an opening 56 is formed in a portion of a top plate 53 that forms the ceiling of the jet pump chamber 22. A connection pipe 61 connects the third exhaust pipe 45 (see FIG. 3). The open/close valve 46 is mounted on the opening 56 from below. The open/close valve 46 is mounted on the connection pipe 61 from below. The top plate 53 is formed horizontally.

Figure 5:
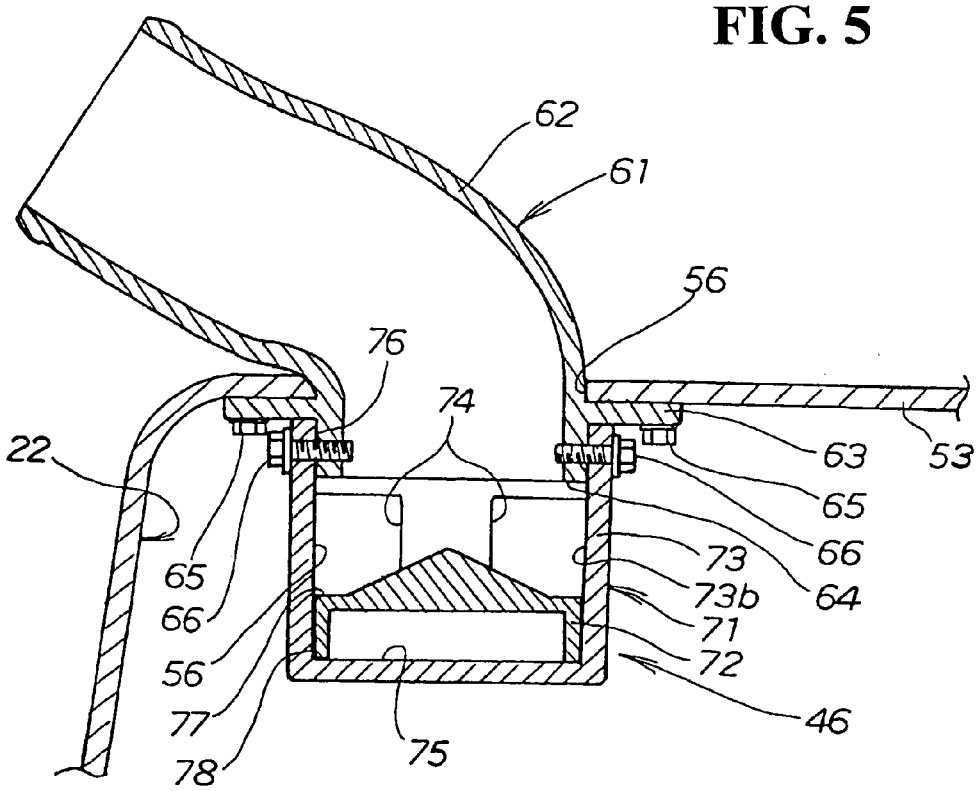
FIG. 5 is a cross-sectional view for explanation of the structure of the open/close valve according to the invention.

FIG. 5 is a cross-sectional view for explaining the structure of the open/close valve according to an embodiment of the present invention.

The connection pipe 61 that is mounted on the opening 56 of the jet pump chamber 22 from below includes a cylindrical body 62. A flange portion 63 is provided below the cylindrical body 62. A seal receiving portion 64 is formed on a lower end of the cylindrical body 62.

The flange portion 63 that is provided on the connection pipe 61 is mounted on the top plate 53 using fastening bolts 65, 65. The open/close valve 46 is mounted on the connection pipe 61 from below using open/close valve fastening bolts 66, 66.

The open/close valve 46 includes a valve casing 71 and a valve element 72 that is vertically movably housed in the valve casing 71. The valve casing 71 includes a cylindrical portion 73 that extends vertically. Through holes 74 are opened in the cylindrical portion 73. A bottom portion 75 is formed on a bottom of the cylindrical portion 73. An exhaust inlet 76 is formed on an upper portion of the cylindrical portion 73. The valve element 72 includes a cylindrical body 78 that is arranged along an inner surface 73*b* of the cylindrical portion 73 provided on the valve casing 71 and has a height that maintains openings of the through holes 74. A seal plate 77 covers an upper portion of the cylindrical body 78 and has a size capable of closing the exhaust inlet 76 formed in the valve casing 71.

When the hull 11 (see FIG. 1) is arranged below and the deck 12 is arranged above, the exhaust gas that enters the valve casing from the exhaust inlet 76 can be discharged to the outside of the valve casing 71 through the through holes 74. When the hull 11 is arranged above and the deck 12 is arranged below, the seal plate 77 of the valve element 72 that is moved due to an action of gravity is brought into contact with the seal receiving portion 64 thus closing the exhaust inlet 76.

Figure 6:
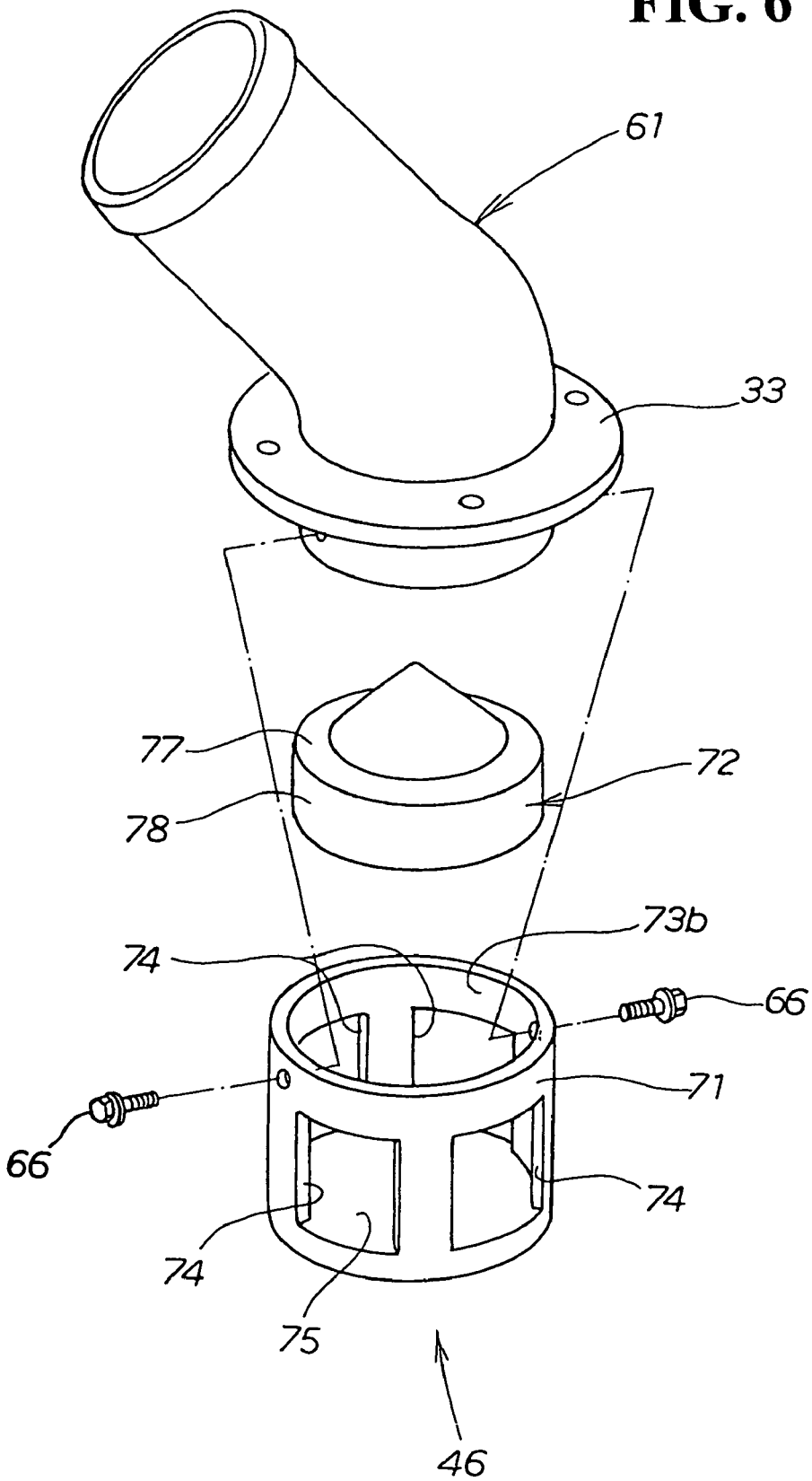
FIG. 6 is a exploded perspective view of the open/close valve according to the invention.

FIG. 6 is an exploded perspective view of an open/close valve according to an embodiment of the present invention and shows the manner of assembling the open/close valve 46 in which the valve element 72 to be housed is mounted in the valve casing 71, and the valve casing 71 is mounted on the connection pipe 61 using the fastening bolts 66. The flange portion 33 that is provided on the connection pipe 61 is mounted on the boat body 13 (see FIG. 1).

Figure 7A:
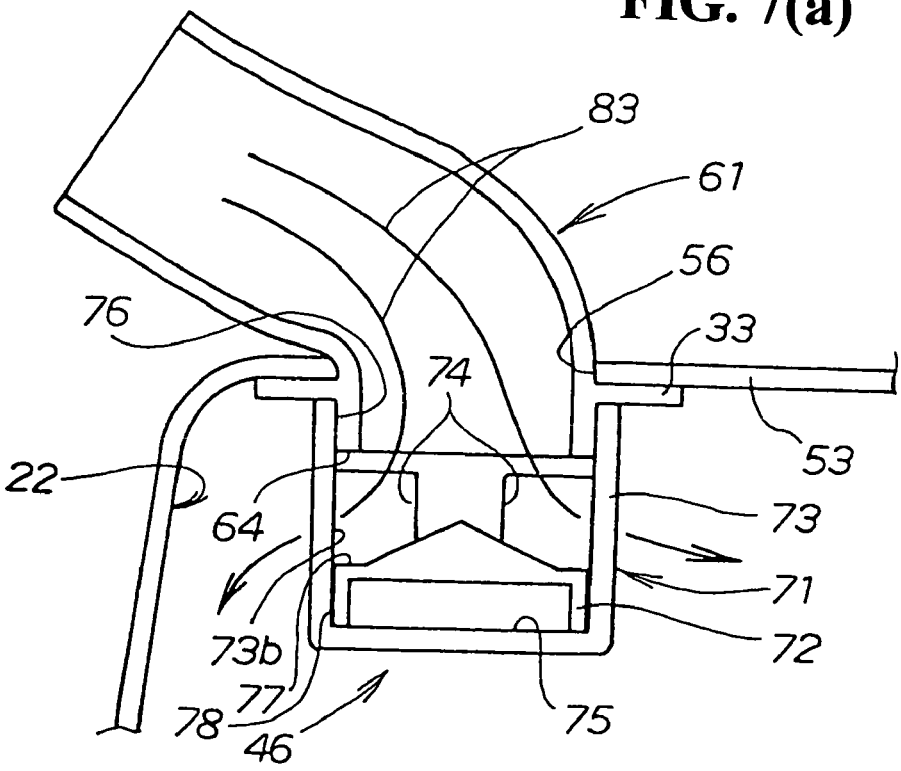
FIGS. 7(*a*) and 7(*b*) are explanatory views of the manner of operation of the open/close valve according to the invention.
Figure 7B:
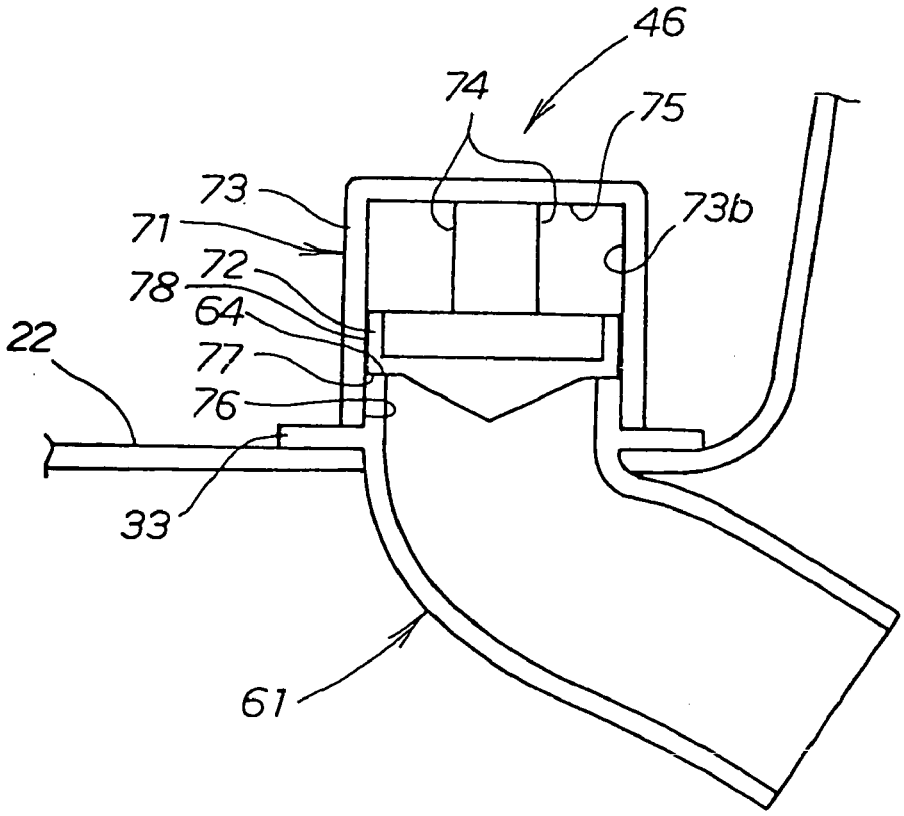

FIGS. 7(*a*) and 7(*b*) are views for explaining the manner of operation of the open/close valve according to the invention. In FIG. 7(*a*), when the hull 11 (see FIG. 1) is arranged below and the deck 12 is arranged above, the valve element 72 is positioned at the bottom portion 75 provided on the valve casing 71 and the exhaust gas passes the opening and is discharged to the jet pump chamber 22 as indicated by an arrow 83.

The valve element 72 is moved to the bottom portion 75 side provided on the valve casing 71 due to a deadweight of the valve element 72. The exhaust inlet 76 and the openings of the through holes 74 formed in the valve casing 71 are in communication with each other. Therefore, the exhaust gas that enters the valve casing from the exhaust inlet 76 is smoothly discharged to the outside of the valve casing 71 through the openings formed in the through holes 74.

In FIG. 7(*b*), when the hull 11 (see FIG. 1) is arranged above and the deck 12 is arranged below, the valve element 72 is moved to an upper portion of the cylindrical portion 73. The seal plate 77 is brought into contact with a seal receiving portion 64 so as to prevent the intrusion of water.

The valve element 72 is moved to the exhaust inlet 76 side provided to the valve casing 71 due to the deadweight of the valve element 72. Therefore, the seal plate 77 of the valve element 72 closes the exhaust inlet 76 whereby the intrusion of water from the exhaust inlet 76 can be avoided as much as possible.

In this manner, the open/close valve 46 that is mounted on the outlet 55 of the exhaust pipe (see FIG. 3) is opened or closed due to the deadweight of the valve element 72. When the hull 11 (see FIG. 1) is arranged above and the deck 12 is arranged below, it is possible to prevent the intrusion of water from the openings of the through holes 74 that are connected to the outlet 55 of the exhaust pipe.

Furthermore, the open/close valve 46 includes the valve casing 71 and the valve element 72. Therefore, the open/close valve 46 has a simple structure. Furthermore, the open/close valve 46 is configured such that the valve element 72 is movable vertically due to the action of gravity along the inner surface 73*b* of the cylindrical portion 73 provided on the valve casing 71. Accordingly, when the hull 11 is arranged below and the deck 12 is arranged above, the exhaust inlet 76 of the valve casing 71 and the openings of the through holes 74 are in communication with each other thus reducing the exhaust resistance.

Figure 8:
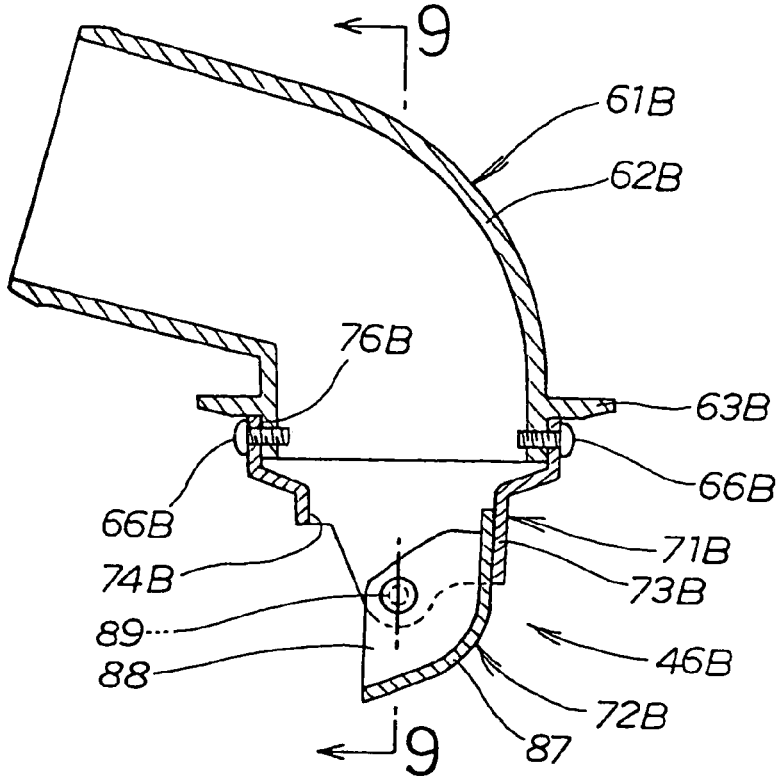
FIG. 8 is a view showing another embodiment of the constitution shown in FIG. 5.

FIG. 8 is another embodiment of the construction shown in FIG. 5. A connection pipe 61B includes a cylindrical body 62B and a flange portion 63B that is mounted on a lower portion of the cylindrical body 62B. Furthermore, an open/close valve 46B is mounted on the connection pipe 61B from below using open/close valve fastening bolts 66B, 66B.

The open/close valve 46B includes a valve casing 71B and a valve element 72B that is tiltably mounted on the valve casing 71B. The valve casing 71B includes a cylindrical portion 73B that extends vertically. A through hole 74B is formed in a bottom of the cylindrical portion 73B. A discharge inlet 76B is formed in an upper portion of the cylindrical portion 73B. The valve element 72B includes a seal plate 87 that has a size capable of closing the through hole 74B. An arm portion 88 extends from the seal plate 87 for allowing the seal plate 87 to tilt. A tilting support shaft 89 is provided at a position where the center of gravity of the valve element 72B at the valve open position and the valve close position is offset from a horizontal line through which a support shaft pivotally supporting the valve element 72B passes.

When the hull 11 (see FIG. 1) is arranged below and the deck 12 is arranged above, the exhaust gas that enters the valve casing from the exhaust inlet 76B can be discharged to the outside of the valve casing 71B through the through hole 74B. When the hull 11 is arranged above and the deck 12 is arranged below, the seal plate 87 of the valve element 72B that is tilted by an action of the gravity closes the through hole 74B.

Figure 9:
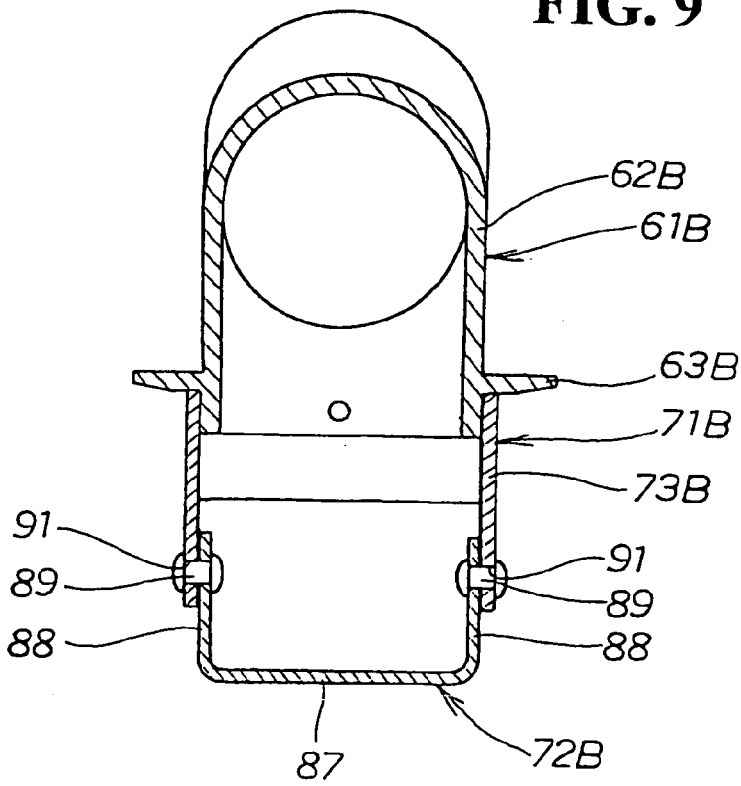
FIG. 9 is a cross-sectional view taken along a line 9—9 in FIG. 8.

FIG. 9 is a cross-sectional view taken along a line 9—9 in FIG. 8, and shows a state in which shaft holes 91, 91 formed in the cylindrical portion 73B are aligned with the left and right arm portions 88, 88 provided on the valve element 72B. The valve element 72B is tiltably mounted on the tilting support shafts 89, 89. The tilting support shafts 89, 89 may be formed of a single shaft and may penetrate between the arm portions 88, 88.

Figure 10A:
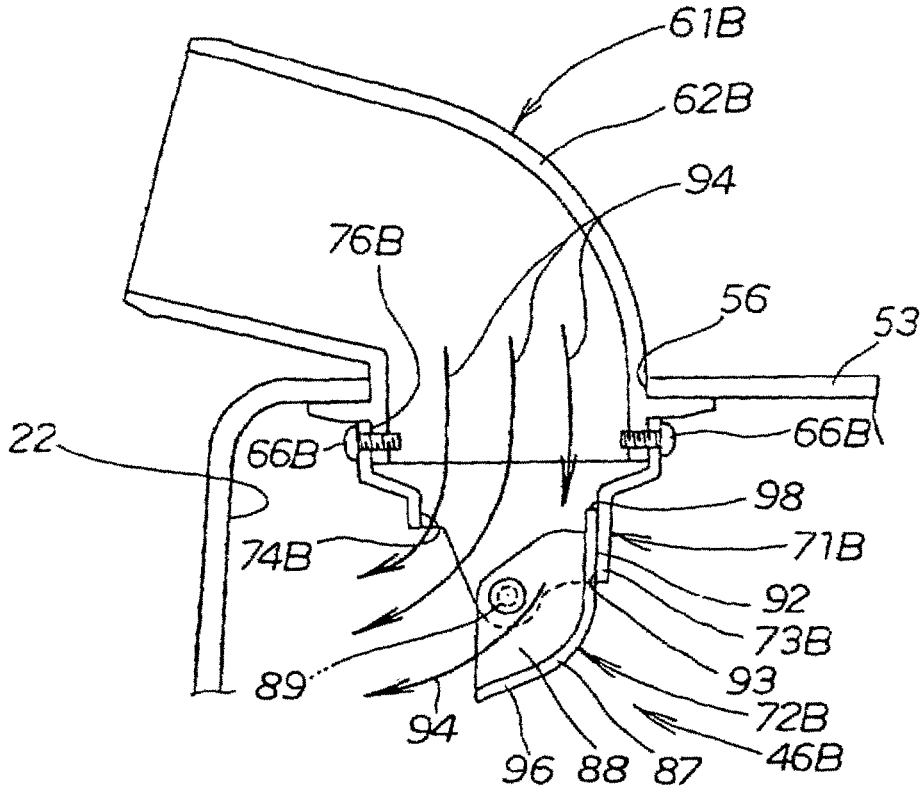
FIGS. 10(*a*) and 10(*b*) are views showing the manner of operation of the construction shown in FIG. 8.
Figure 10B:
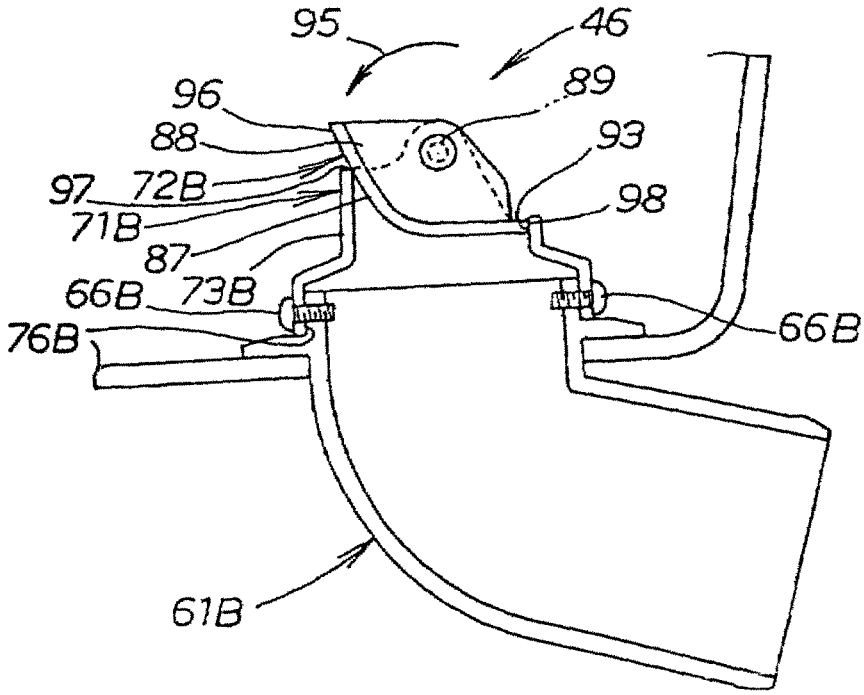

FIGS. 10(*a*) and 10(*b*) are views showing the manner of operation of the embodiment shown in FIG. 8. In FIG. 10(*a*), when the hull 11 (see FIG. 1) is arranged below and the deck 12 is arranged above, due to the deadweight of the valve element 72B, using the tilting support shaft 89 of the valve element 72B as an axis, an upper portion 92 of the seal plate 87 provided to the valve element 72B is brought into contact with an inner surface 93 of the cylindrical portion 73B, thus forming an opening in the through hole 74B. Therefore, the exhaust gas passes the opening and is discharged to the jet pump chamber 22 as indicated by an arrow 94.

There is no possibility that the seal plate 87 of the valve element 72B closes the through hole 74B of the valve casing 71B. Therefore, the exhaust gas that enters the valve casing from the exhaust inlet 76B can be discharged to the outside of the valve casing 71B through the opening formed in the through hole 74B. In this manner, the opening of the through hole 74B which constitutes the exhaust pipe outlet is largely opened. Therefore, even when cooling water is discharged together with the exhaust gas, the exhaust gas resistance is not increased.

In FIG. 10(*b*), when the hull 11 (see FIG. 1) is arranged above and the deck 12 is arranged below, due to the deadweight of the valve element 72B, the valve element 72B is tilted in the direction indicated by an arrow 95 using the tilting support shaft 89 as an axis. Therefore, a lower portion 96 of the seal plate 87 provided on the valve body 72B is brought into contact with an end portion 97 of the cylindrical portion. At the same time, an end portion 98 of the seal plate is brought into contact with an inner surface 93 of the cylindrical portion 73B thus preventing the intrusion of water.

The seal plate 87 of the valve element 72B is tilted about the tilting support shaft 89 and closes the through hole 74B of the valve casing 71B. Therefore, the intrusion of water from the exhaust inlet 76B can be prevented as much as possible.

The open/close valve 46B includes the valve casing 71B and the valve element 72B. Therefore, the open/close valve 46B has a simple construction.

Furthermore, the valve element 72B mounts the tilting support shaft 89 on the arm portion 88 of the valve element at the position where the center of gravity of the valve element 72B at the valve opening and valve closing positions is offset thus allowing the valve element 72B to be tiltable due to the action of gravity. Therefore, when the hull 11 (see FIG. 1) is arranged below and the deck 12 is arranged above, the exhaust inlet 76B of the valve casing 71B and the opening 56B of the through hole are in communication with each other thus giving rise to an advantage that the exhaust resistance can be reduced.

The present invention is preferably applicable to a jet propelling boat.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust device for a boat, the boat including a boat body having a hull that forms a boat bottom and a deck that covers the hull, and an engine that is arranged inside the boat body, said exhaust device comprising:

an exhaust pipe that leads exhaust gas generated by the engine to the outside of the boat body; and an open/close valve mounted on an outlet of the exhaust pipe, the open/close valve including a valve casing and a valve element that is housed in the valve casing in a vertically movable manner, the valve casing including a cylindrical portion that extends vertically, a through hole formed in the cylindrical portion, a bottom portion mounted on a bottom of the cylindrical portion, and an exhaust inlet mounted on an upper portion of the cylindrical portion, and the valve element including a cylindrical body that is arranged along an inner surface of the cylindrical portion and has a height that allows the through hole to be maintained in an open position, and a sealing plate that covers an upper portion of the cylindrical body and has a size that allows the sealing plate to close the exhaust inlet, wherein when the hull is arranged below the deck, the exhaust gas that enters the valve casing through the exhaust inlet is discharged to the outside of the valve casing through the through hole, and when the hull is arranged above the deck, the sealing plate of the valve element is moved due to gravity to close the exhaust inlet.

2. The exhaust device for a boat according to claim 1, wherein the exhaust pipe includes a water muffler in a middle portion thereof, the exhaust pipe discharging cooling water together with the exhaust gas from the outlet of the exhaust pipe.

3. The exhaust device for a boat according to claim 1, wherein the exhaust pipe includes a first exhaust pipe, a second exhaust pipe in communication with the first exhaust pipe through a first water muffler, and a third exhaust pipe in communication with the second exhaust pipe through a second water muffler, and wherein the open/close valve is mounted on an outlet of the third exhaust pipe.

4. The exhaust device for a boat according to claim 1, wherein the open/close valve is mounted on a top plate that forms a ceiling of a jet pump chamber of the boat, said open/close valve being located within the jet pump chamber.

5. The exhaust device for a boat according to claim 3, wherein the open/close valve is mounted on a top plate that forms a ceiling of a jet pump chamber of the boat at a location between the first water muffler and the second water muffler.

6. An exhaust device for a boat, the boat including a boat body having a hull that forms a boat bottom and a deck that covers the hull, and an engine that is arranged inside the boat body, said exhaust device comprising:

an exhaust pipe that leads exhaust gas generated by the engine to the outside of the boat body; and an open/close valve mounted on an outlet of the exhaust pipe, the open/close valve including a valve casing and a valve element that is tiltably mounted on the valve casing, the valve casing including a cylindrical portion that extends vertically, a through hole formed in a bottom of the cylindrical portion, and an exhaust inlet formed in an upper portion of the cylindrical portion, and the valve element including a sealing plate having a size that allows the sealing plate to close the through hole, an arm portion that extends from the sealing plate to allow the sealing plate to tilt, and a tilting support shaft provided on the arm portion at a position where a center of gravity of the valve element at a valve opened position and a valve closed position is offset from a horizontal line passing through a support shaft that tiltably supports the valve element, wherein when the hull is arranged below the deck, the exhaust gas that enters the valve casing through the exhaust inlet is discharged to the outside of the valve casing through the through hole, and when the hull is arranged above the deck, the sealing plate of the valve element is tilted due to gravity to close the through hole.

7. The exhaust device for a boat according to claim 6, wherein the exhaust pipe includes a water muffler in a middle portion thereof, the exhaust pipe discharging cooling water together with the exhaust gas from the outlet of the exhaust pipe.

8. The exhaust device for a boat according to claim 6, wherein the exhaust pipe includes a first exhaust pipe, a second exhaust pipe in communication with the first exhaust pipe through a first water muffler, and a third exhaust pipe in communication with the second exhaust pipe through a second water muffler, and wherein the open/close valve is mounted on an outlet of the third exhaust pipe.

9. The exhaust device for a boat according to claim 6, wherein the open/close valve is mounted on a top plate that forms a ceiling of a jet pump chamber of the boat, said open/close valve being located within the jet pump chamber.

10. The exhaust device for a boat according to claim 8, wherein the open/close valve is mounted on a top plate that forms a ceiling of a jet pump chamber of the boat at a location between the first water muffler and the second water muffler.

11. An exhaust device for a boat, the boat including a boat body having a hull that forms a boat bottom and a deck that covers the hull, and an engine that is arranged inside the boat body, said exhaust device comprising:

an exhaust pipe that leads exhaust gas generated by the engine to the outside of the boat body; and an open/close valve mounted on an outlet of the exhaust pipe, the open/close valve including a valve casing and a valve element that is movable with respect to the valve casing, the valve element including a sealing plate that is movable by gravity to open and close the open/close valve, wherein when the hull is arranged below the deck, the exhaust gas that enters the valve casing through the exhaust inlet is discharged to the outside of the valve casing, and when the hull is arranged above the deck, the sealing plate of the valve element is moved due to gravity to close the open/close valve to prevent discharge of exhaust gas outside of the valve casing.

12. The exhaust device for a boat according to claim 11, wherein the exhaust pipe includes a water muffler in a middle portion thereof, the exhaust pipe discharging cooling water together with the exhaust gas from the outlet of the exhaust pipe.

13. The exhaust device for a boat according to claim 11, wherein the exhaust pipe includes a first exhaust pipe, a second exhaust pipe in communication with the first exhaust pipe through a first water muffler, and a third exhaust pipe in communication with the second exhaust pipe through a second water muffler, and wherein the open/close valve is mounted on an outlet of the third exhaust pipe.

14. The exhaust device for a boat according to claim 11, wherein the open/close valve is mounted on a top plate that forms a ceiling of a jet pump chamber of the boat, said open/close valve being located within the jet pump chamber.

15. The exhaust device for a boat according to claim 13, wherein the open/close valve is mounted on a top plate that forms a ceiling of a jet pump chamber of the boat at a location between the first water muffler and the second water muffler.

16. The exhaust device for a boat according to claim 11, wherein the valve element is housed in the valve casing in a vertically movable manner, said valve casing including a cylindrical portion that extends vertically, a through hole formed in the cylindrical portion, an exhaust inlet in communication with the outlet of the exhaust pipe at a top of the cylindrical portion and a closed bottom, said valve element including a cylindrical body arranged along an inner surface of the cylindrical portion and having a height that allows the opening of the through hole to be maintained in an open position, and said sealing plate has a size that allows the sealing plate to close the exhaust inlet.

17. The exhaust device for a boat according to claim 11, wherein the valve element is tiltably mounted on the valve casing, the valve casing including a cylindrical portion that extends vertically, a through hole formed in a bottom of the cylindrical portion, and an exhaust inlet formed in an upper portion of the cylindrical portion, said valve element including an arm portion that extends from the sealing plate to allow the sealing plate to tilt, and a tilting support shaft provided on the arm portion at a position where a center of gravity of the valve element at a valve opened position and a valve closed position is offset from a horizontal line passing through a support shaft that tiltably supports the valve element, and said sealing plate has a size that allows the sealing plate to close the through hole.

18. The exhaust device for a boat according to claim 11, wherein the valve element is housed in the valve casing and the valve element is movable vertically with respect to the valve casing.

19. The exhaust device for a boat according to claim 11, wherein the valve element is tiltably mounted on the valve casing.

* * * * *